US006457207B1

(12) United States Patent
Hörberg

(10) Patent No.: US 6,457,207 B1
(45) Date of Patent: Oct. 1, 2002

(54) STOP ARRANGEMENT FOR A PIVOTABLE DOOR

(75) Inventor: Arne Hörberg, Olofström (SE)

(73) Assignee: Volvo Car Corporation (SE)

( * ) Notice: Subject to any disclaimer, the term of this patent is extended or adjusted under 35 U.S.C. 154(b) by 0 days.

(21) Appl. No.: 09/611,795

(22) Filed: Jul. 7, 2000

(30) Foreign Application Priority Data

Jul. 7, 1999 (SE) ..... 9902614

(51) Int. Cl.[7] ..... E05F 3/20; E05D 11/10

(52) U.S. Cl. ..... 16/50; 16/330; 16/334

(58) Field of Search ..... 16/50, 54, 330, 16/334, 303, 82, 372, 376, 328, 331, 332; 296/146.11, 146.12; 292/60–62, 279, DIG. 17

(56) References Cited

U.S. PATENT DOCUMENTS 4,829,633 A * 5/1989 Kassner ..... 16/322
5,031,270 A * 7/1991 Lee ..... 16/341
5,408,726 A * 4/1995 Kent ..... 16/330
5,878,463 A * 3/1999 Kluting et al. ..... 16/330
5,913,350 A * 6/1999 Kluting et al. ..... 16/330
5,970,819 A * 10/1999 Katoh ..... 16/303

FOREIGN PATENT DOCUMENTS

| | | |
|---|---|---|
| DE | 3641602 A1 * | 6/1988 |
| DE | 4212181 | 10/1993 |
| DE | 29714408 | 1/1999 |
| GB | 1444556 | 8/1976 |

* cited by examiner

*Primary Examiner*—Chuck Y. Mah
(74) *Attorney, Agent, or Firm*—Howrey, Simon, Arnold & White LLP

(57) ABSTRACT

Stop arrangement (1) for stopping a door which is pivotable about an axis of rotation (5), the stop arrangement includes a first member (10) which, is connected to the door and is adapted so as to interact with a second member (11) connected to a body part. The first and second members (10, 11) have surfaces (12) which face one another and are designed in such a manner in relation to one another that the torque about the axis of rotation (5) will vary when the door pivots about the axis of rotation (5). A force element (13) is arranged so as to bring the first and the second member (10, 11) together with one another with a force, the direction of which is parallel or at least essentially parallel to the longitudinal direction of the axis of rotation (5).

13 Claims, 7 Drawing Sheets

STOP ARRANGEMENT FOR A PIVOTABLE DOOR

TECHNICAL FIELD

Figure 1:
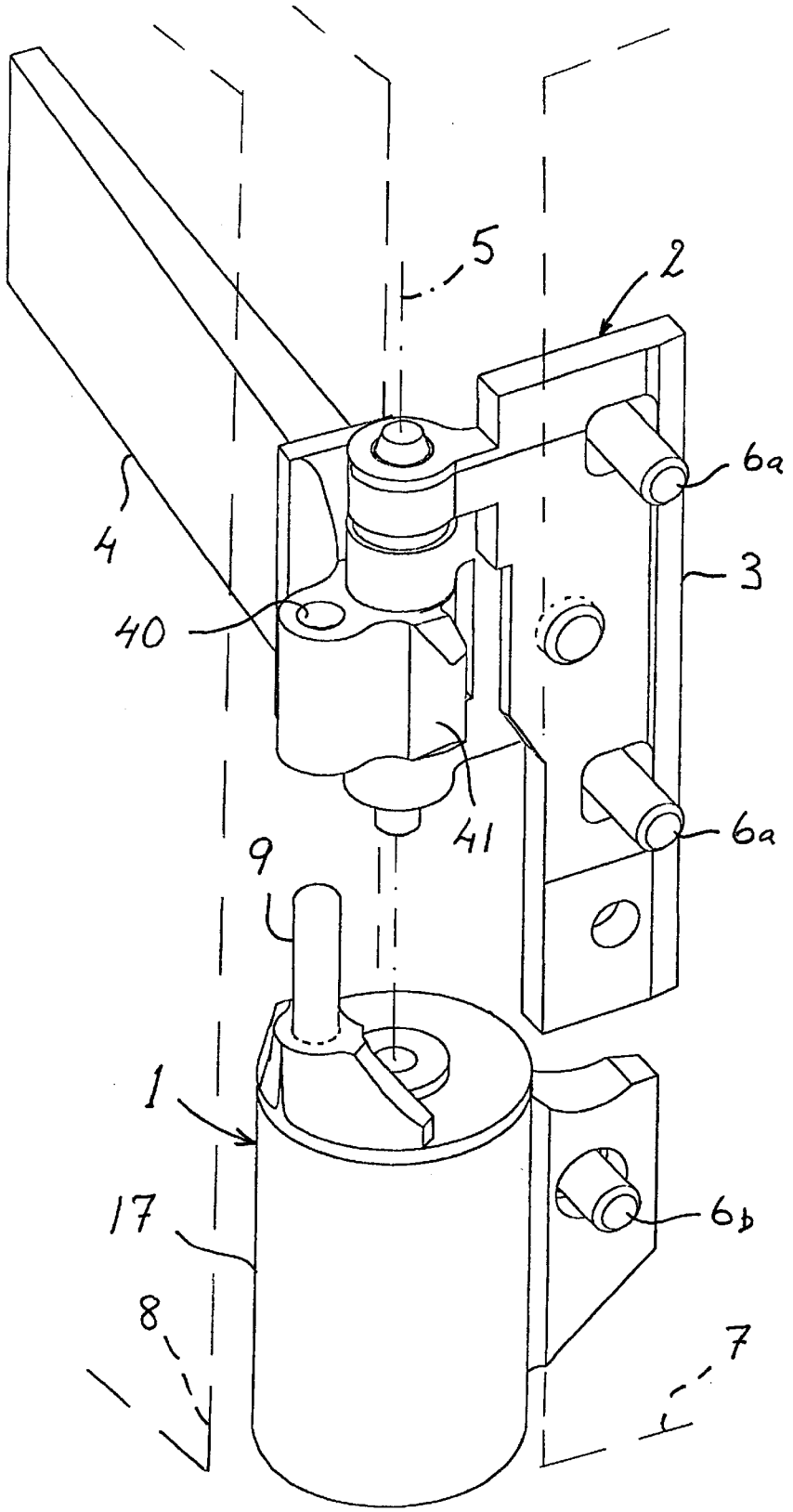

The present invention relates to a stop arrangement for stopping a door which is pivotable about an axis of rotation, which stop arrangement comprises a first member which is connected to the door and is adapted so as to interact with a second member connected to a body part, which first and second members comprise surfaces which face one another and are designed in such a manner in relation to one another that the torque about the axis of rotation will vary when the door pivots about the axis of rotation.

BACKGROUND OF THE INVENTION

Stop arrangements for doors, such as doors for vehicles, private cars, lorries, excavators etc., are used to bring about one or more intermediate positions, in which the door will stop, between a first and a second position of the door. A vehicle door may be, for example, closed (first position) or completely open (second position). In this case, the intermediate positions prevent the door from being unintentionally opened to the completely open position, which thus prevents cars parked alongside from being struck by the door. In the same way, the door is prevented from being shut with great force to the closed position. Under certain circumstances, for example for airing the passenger compartment, it is also desirable for the door to be stopped and held slightly open.

It is previously known to provide a vehicle door with a separate stop arrangement. Such a stop arrangement is disclosed in DE 24 15 888 C2 and comprises an arm which is connected to the door and follows the movement of the door about an axis of rotation. In a given opening position, the arm is. fixed between two spring-loaded rollers. In order to pass the rollers, the spring force acting on the rollers must be overcome.

According to another known stop arrangement, which is disclosed in DE 296 16 259 U1, the hinge of a vehicle door is provided with a spring-loaded pin which, in given opening positions of the door, is inserted into a groove in the opposite hinge element.

It is common to the known stop arrangements that a force from a spring element, which force is directed radially in relation to the axis of rotation, ensures that the door is stopped and retained in a predetermined opening position. This results in the stop arrangement requiring space radially in relation to the axis of rotation of the door. The known constructions based on a radially directed force also make enclosure difficult, which results in the construction being susceptible to dirt and the risk of pinching being great. Stop arrangements which contain moving parts have to be lubricated. As the known stop arrangements are not enclosed, they will dirty surrounding components with lubricating grease.

One object of the present invention is to produce a stop arrangement for doors which requires a small radial space in relation to an axis of rotation of the door.

Another object of the present invention is to produce a stop arrangement for doors which is protected from impurities.

A further object of the present invention is to produce a stop arrangement for doors which does not dirty surrounding components.

A further object of the present invention is to produce a stop arrangement for doors which minimizes thief pinching risk for hands and fingers.

SUMMARY OF THE INVENTION

This is achieved by a stop arrangement of the type indicated hereinabove, in which a force element is arranged so as to bring the first and the second member together with one another with a force, the direction of which is parallel or at least essentially parallel to the longitudinal direction of the axis of rotation.

Such a stop arrangement has small dimensions in the radial direction because the force element can be designed in such a manner that it extends essentially in the longitudinal direction of the axis of rotation. As the force element can extend essentially in the longitudinal direction of the axis of rotation, the components forming part of the stop arrangement can advantageously be enclosed, which means that those surfaces of the first and the second member which face one another will not be exposed to dirt, which prolongs the life of the stop arrangement. At the same time, lubricating grease from the stop arrangement will not dirty surrounding components. An enclosed stop arrangement also reduces the pinching risk.

Further advantages are achieved by means of the features indicated in the subclaims.

Figure 2:
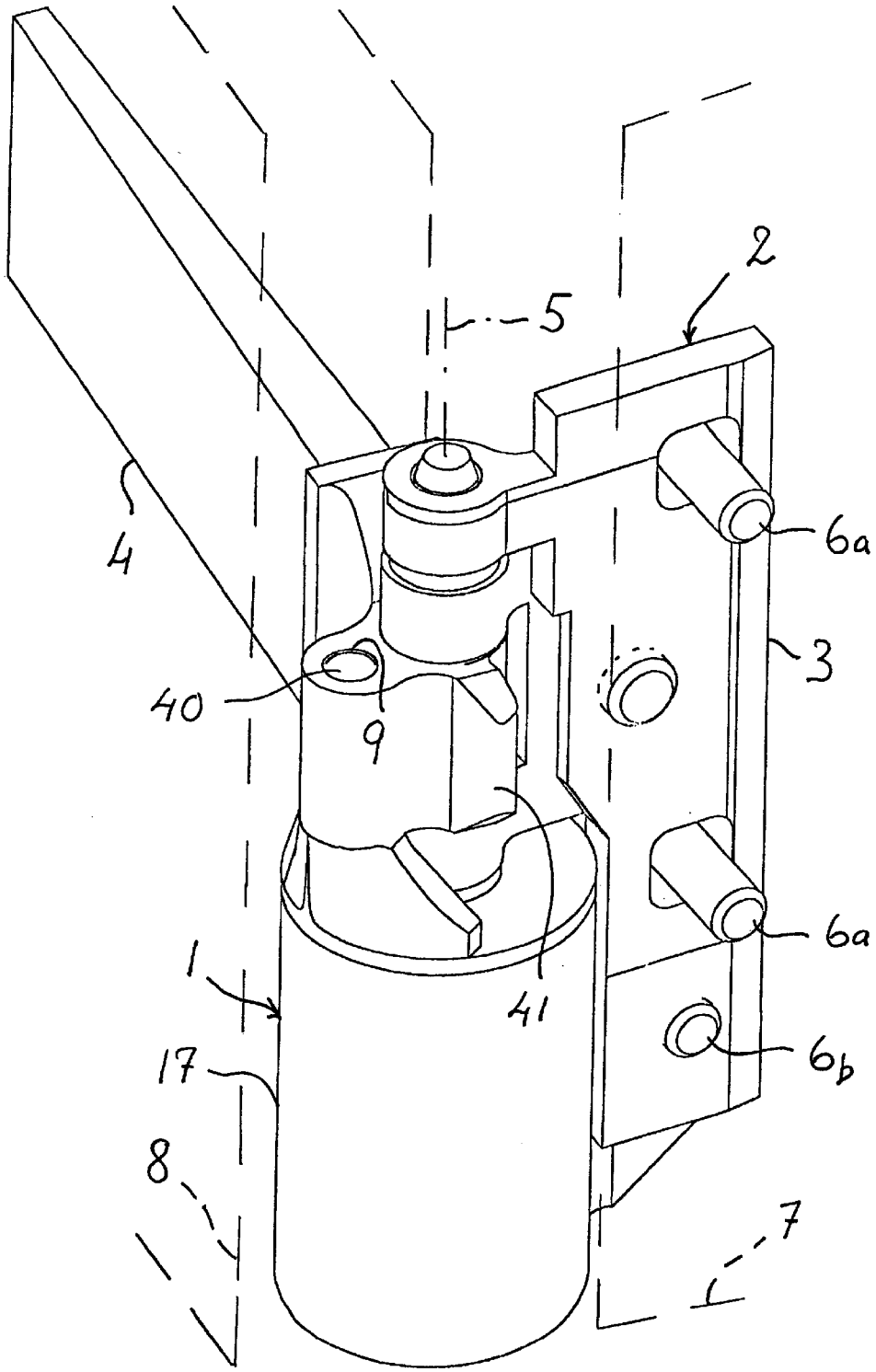
Figure 3:
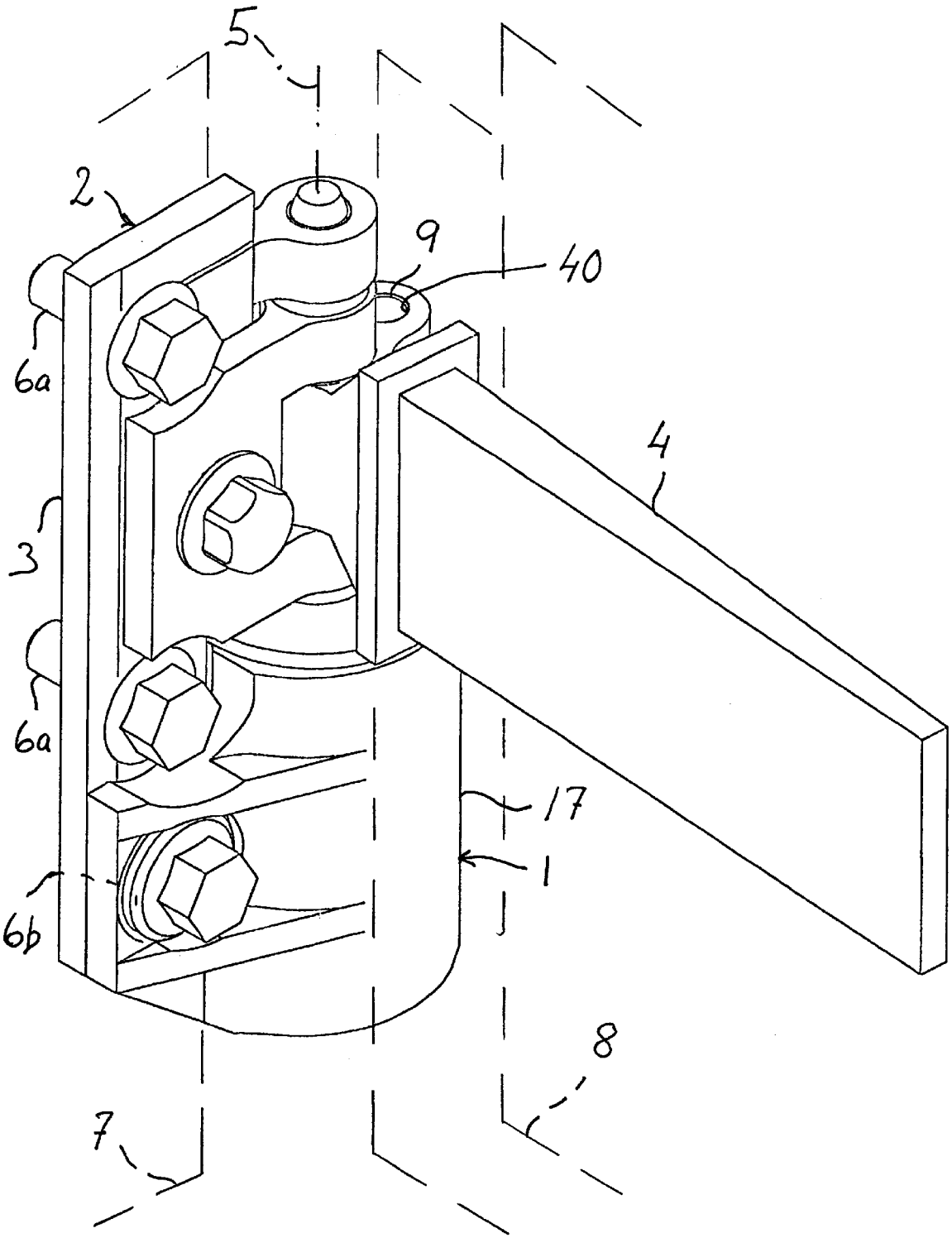
Figure 4:
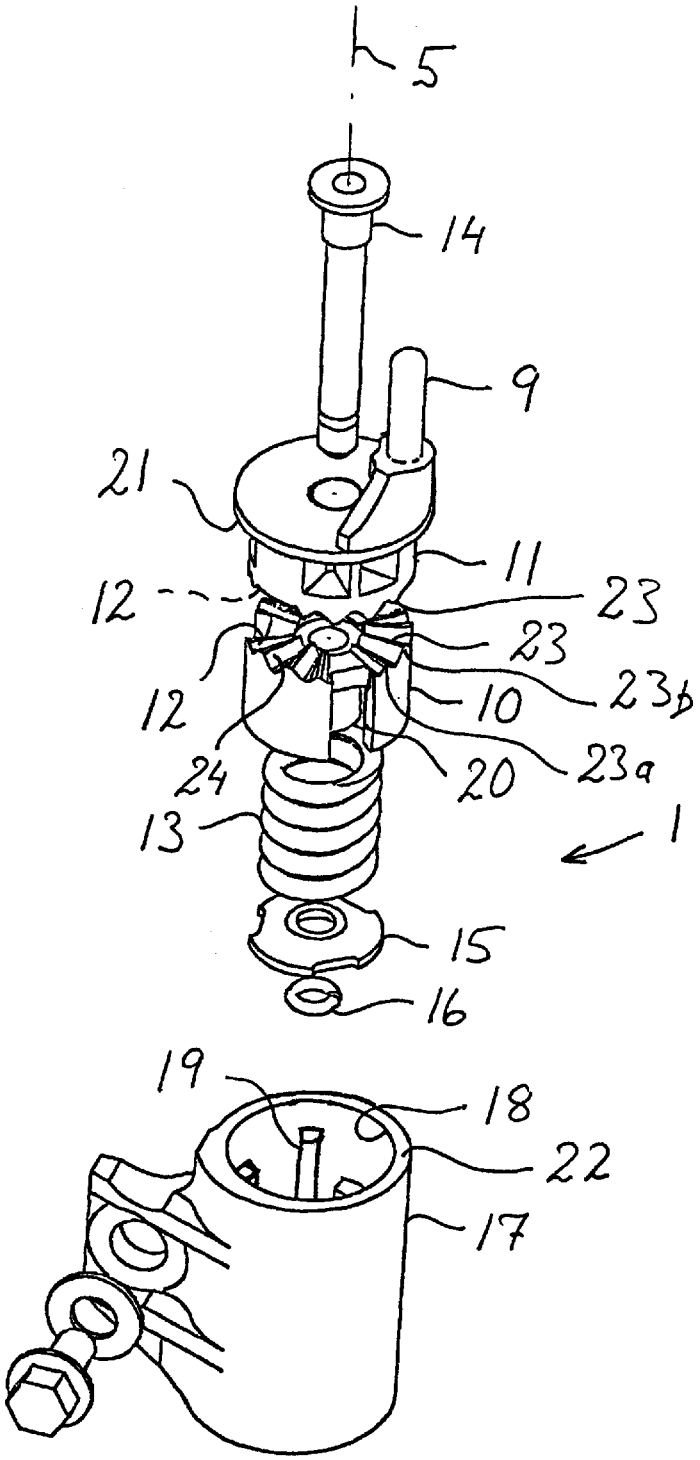
Figure 5:
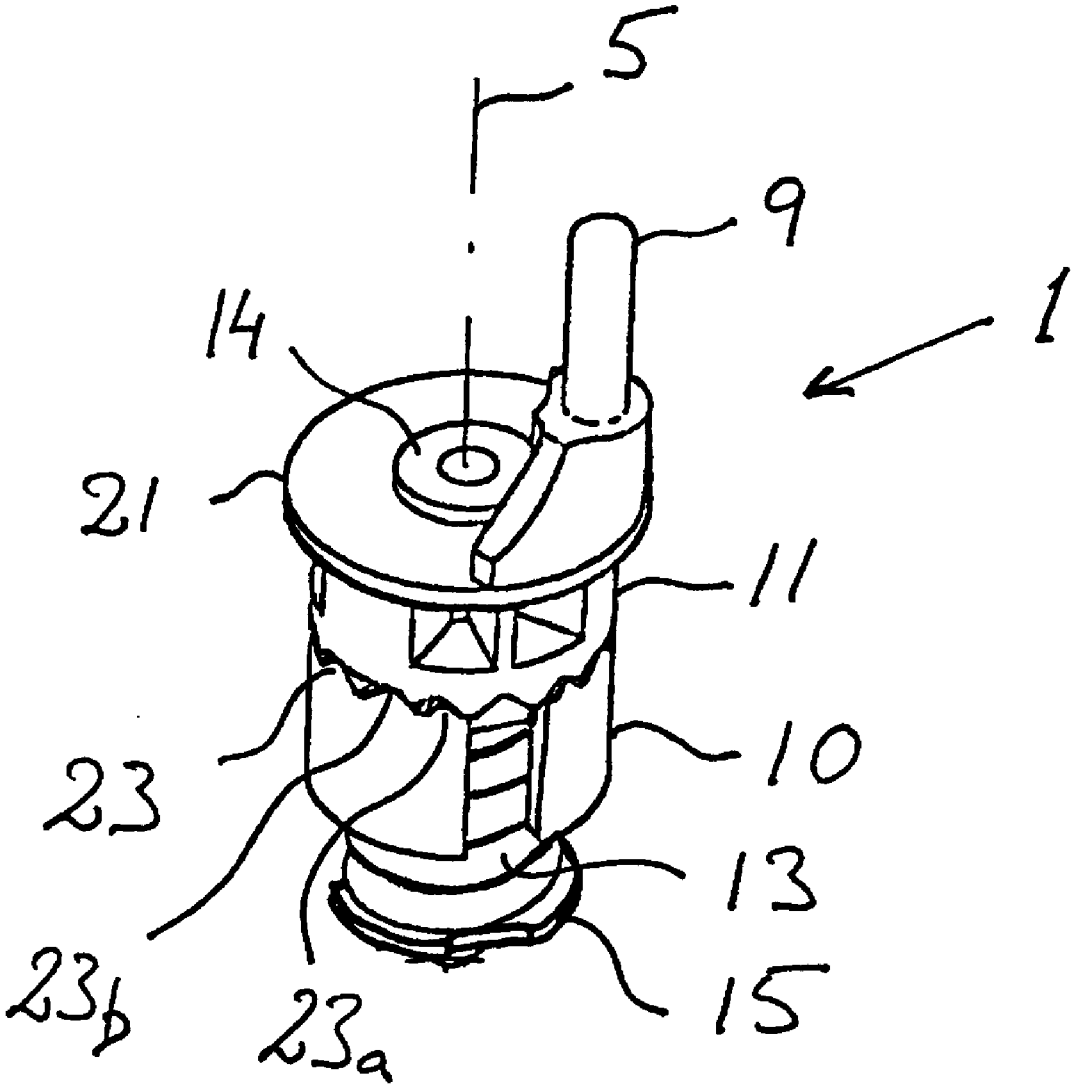
Figure 6A:
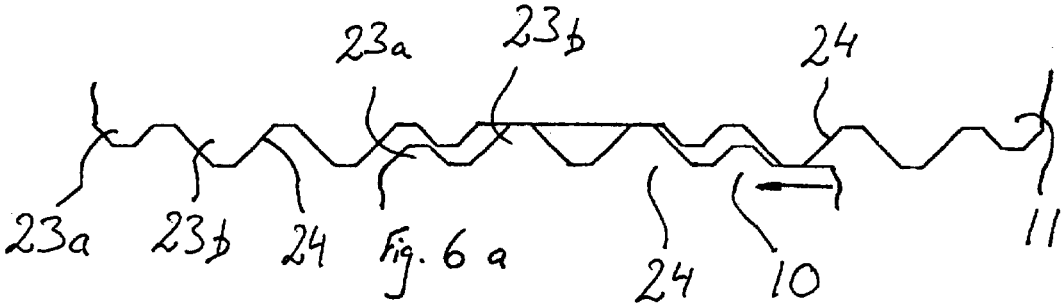
Figure 6B:
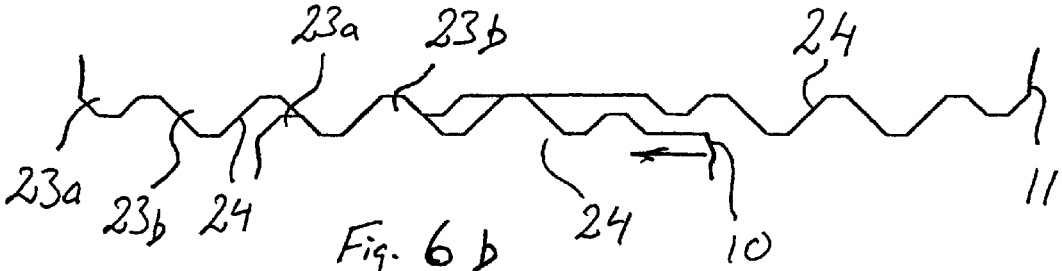
Figure 6C:
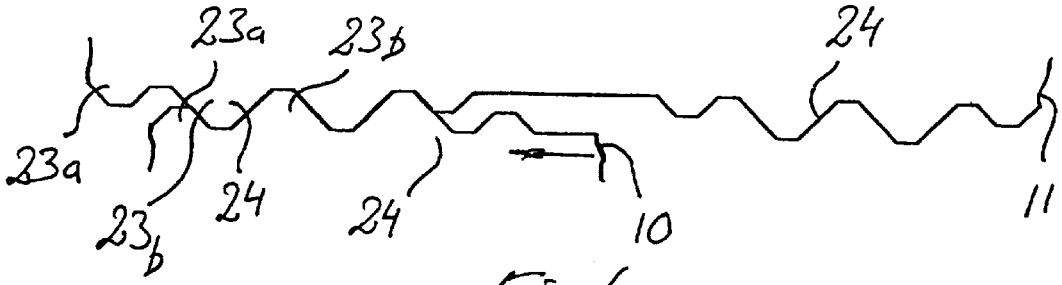
Figure 6D:
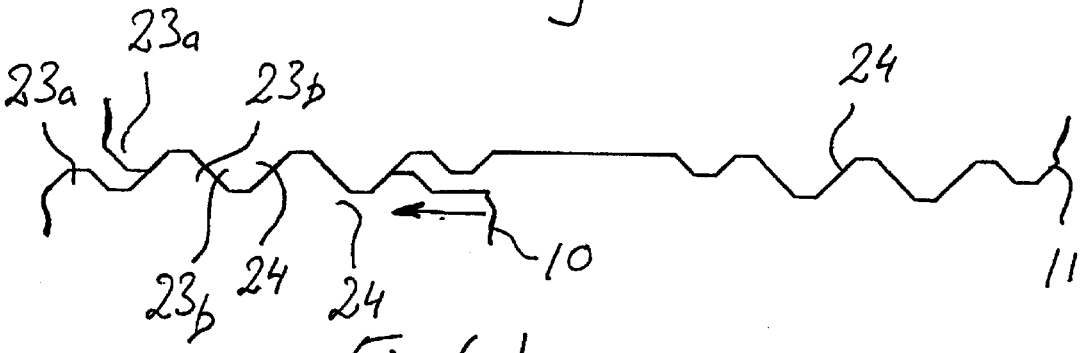
Figure 7:
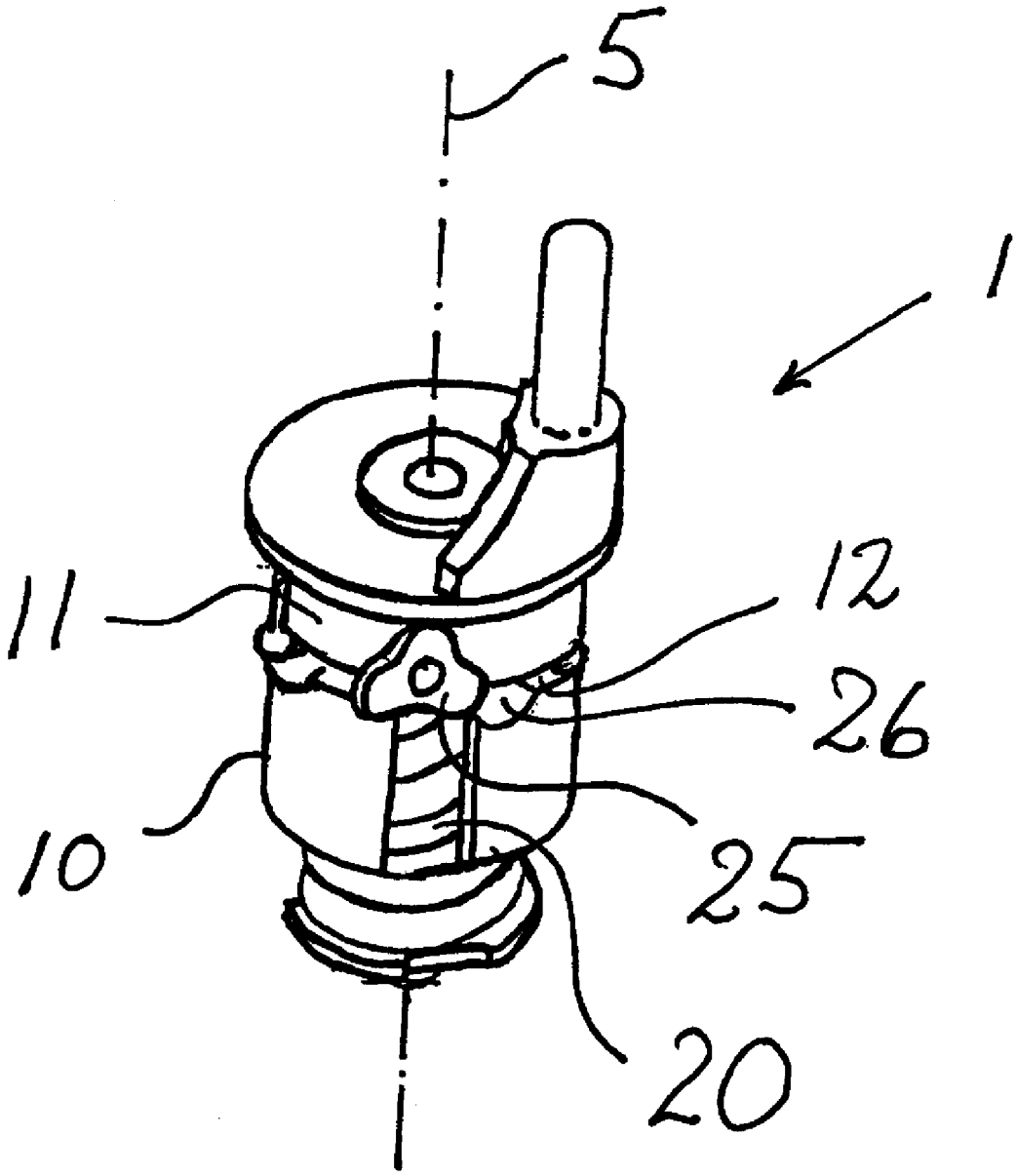

The invention is described in greater detail below by means of exemplary embodiments shown in the appended drawings, in which FIG. 1 shows a perspective view of a first exemplary embodiment of a stop arrangement according to the present invention on a hinge, FIG. 2 shows a perspective view of the stop arrangement according to FIG. 1 mounted on a hinge, FIG. 3 shows a perspective view of the stop arrangement according to FIG. 1 on a hinge, FIG. 4 shows an exploded diagram of the stop arrangement according to FIG. 1, FIG. 5 shows a perspective view of the stop arrangement according to FIG. 1, FIGS. 6*a*–6*d* show a diagrammatic illustration relating to the stop arrangement according to FIG. 1 in different stopping positions, and FIG. 7 shows a second exemplary embodiment of a stop arrangement according to the present invention.

DETAILED DESCRIPTION OF THE INVENTION

FIGS. 1–3 show how a stop arrangement 1 according to a first exemplary embodiment of the present invention can be mounted on a hinge 2 which comprises a first and a second hinge element 3, 4. The hinge elements 3, 4 are articulated about an axis of rotation 5. In FIG. 1, the stop arrangement 1 is shown at a distance from the hinge 2. The first hinge element 3 can be connected by means of fastening elements 6*a* to a pivoting door 7, such as the passenger door, the boot or the bonnet of a vehicle. The second hinge element 4 can be connected to a more generally stationary 8, such as a body member or a beam of the vehicle. The door 7 will therefore be pivotable about the axis of rotation 5. The stop arrangement 1 has a cylinder 17 and is connected by means of a fastening element 6*b* to the first hinge element 3 and by means of a pin 9 to the second hinge element 4 to form a unit, as shown in FIG. 2. It is possible to connect the stop arrangement 1 to the hinge elements 3, 4 in another way. For example, the fastening element 6*a* connecting the first hinge element 3 to the door 7 can also be used to connect the stop arrangement 1 to the first hinge element 3. In the exemplary embodiment shown, the pin 9 is connected to the stop arrangement 1. When the stop arrangement 1 is mounted on the hinge 2, the pin 9 is introduced into a bore 40 in the second hinge element 4 which also has a stop 41. Alternatively, however, it is possible to design the second hinge element 4 with a pin which is introduced into a recess (not shown) in the stop arrangement 1. FIG. 3 shows how the stop arrangement 1 is mounted on the hinge 2, seen in a different direction from FIG. 2. It can be seen from the figures that the axis of rotation 5 extends through the stop arrangement 1. The stop 41 limits the maximum possible angle of rotation through which the hinge element 4 can be rotated in relation to the hinge element 3.

FIG. 4 shows an exploded diagram of the stop arrangement 1 according to FIG. 1. The stop arrangement 1 comprises a first and a second member 10, 11, each of the has a surface 12, which surfaces face one another and are designed in such a manner in relation to one another that the torque about the axis of rotation 5 will vary when the door 7 pivots about the axis of rotation 5. A force element in the form of a coil spring 13 presses the first member 10 against the second member 11. The first and the second member 10, 11 are thus brought together by a force acting from the spring 13, the direction of which is parallel or at least essentially parallel to the longitudinal direction of the axis of rotation 5. The first and the second member 10, 11 and the spring 13 are held together by a fastening device 14, a washer 15 and a lock ring 16. The fastening device 14 extends through the first and the second member 10, 11 and the spring, and, in the mounted position of the stop arrangement 1, the longitudinal axis of the fastening device 14 coincides with the axis of rotation 5. FIG. 5 shows how the first and the second member 10, 11 and the spring 13 are held together by the fastening device 14.

The first member 10 is displaceable in the longitudinal direction of the axis of rotation 5 in a cylinder 17 which comprises on the inner wall 18 at least one fixing element 19 which interacts with the first member 10 and prevents the first member 10 from being rotated in the cylinder 17. According to the embodiment shown, the fixing element 19 consists of three ribs positioned symmetrically in the cylinder 17. The ribs 19 engage in the corresponding recesses 20 formed in the first member 10.

The second member 11 is arranged rotatably in the cylinder 17 and is designed in such a manner that, together with the cylinder 17, it defines a closed space. The second member 11 is provided with a flange 21 which comes to bear against an end surface 22 of the cylinder 17. As a result, dirt particles cannot reach the surfaces 12 of the first and the second member 10, 11. At the same time, grease contained in the cylinder 17 cannot dirty surrounding components outside the closed space.

As shown in FIGS. 1–3, the cylinder 17 is connected to the first hinge element 3 and the pin 9 arranged on the second member 11 is connected to the second hinge element 4. As the first member 10 is prevented from rotating in relation to the cylinder 17, the cylinder 17 will drive the first member 10 when the door 7 is rotated about the axis of rotation 5. The first member 10 will therefore be rotated about the axis of rotation 5 when the first hinge element 3 of the door 7 is rotated about the axis of rotation 5. The second member 11 is fixed to the second hinge element 4, however, and will therefore remain in the rest position when the second hinge element 4 remains stationary. During this relative rotation of, the hinge elements 3, 4 about the axis of rotation 5, the first and the second member 10, 11 will be rotated in relation to one another. The first and the second member 10, 11 preferably have a rotationally symmetrical shape with an axis of symmetry which coincides with the axis of rotation 5 about which the door 7 pivots.

As mentioned above, those surfaces 12 of the first and the second member 10, 11 which face one another are designed in such a manner in relation to one another that the torque about the axis of rotation will vary when the door 7 pivots about the axis of rotation 5. According to the first embodiment, those surfaces 12 of the first and the second member 10, 11 which face one another are provided with teeth 23 which extend in a ring on each surface 12. In order to achieve stability during rotation of the door 7 about the axis of rotation 5, each surface 12 is divided into three sectors 24 which are each provided with four teeth 23. The sectors 24 are arranged symmetrically on the surface 12. This symmetrical division into sectors 24 also means that a controlled change in torque can be achieved when the door 7 pivots about the axis of rotation 5.

When the first member 10 is rotated in relation to the second member 11, the toothed surfaces 12 will slide against one another. When the tops of the teeth 23 on the respective members 10, 11 are to pass one another, a given minimum torque must be exceeded. This torque depends on inter alia the magnitude of the spring force of the spring 13 and the shape, height and number of the teeth 23. When, during rotation, the tops of the teeth 23 have passed one another, the teeth 23 on the respective members 10, 11 will then engage in one another and thus stop the door 7. In order to further rotate the door 7 about the axis of rotation 5, additional force must be applied to the door, so that the abovementioned minimum torque is exceeded.

With the four teeth 23 arranged in each sector 24, the door 7 will be subjected to three stops when it is rotated between two end positions for example of a vehicle door rotating between the closed and the completely open position. The outer teeth 23*a* in each sector 24 are preferably smaller than the other two teeth 23*b*, which means that a lower torque is required to move the door to a stop position when a small tooth 23*b* is in engagement compared with the torque required in order to move the door 7 to the two other stop positions when the larger teeth 23*b* are in engagement. As the smaller teeth 23*a* are positioned on the outside, the first stop that the door 7 reaches when it is opened from a closed position will require a lower torque to be reached than is required in order to reach the following stops. If the door 7 is a vehicle door, it will thus be easier to move the door to the first stop compared with the second and third stop when the door is opened.

The way in which the teeth 23 interact with one another will be described in greater detail with reference to FIGS. 6*a*–6*d* which show a diagrammatic part view of the teeth 23 of the first and the second member 10, 11, in which a portion of the first and the second member 10, 11 has, for the purpose of clarification, been straightened out in a plane. One sector 24 comprising four teeth 23 of the first member 10, and two sectors; 24 each comprising four teeth 23 of the second member 11 are shown, the two outer teeth 23*a* being smaller in height than the other two teeth 23*b* between the two outer teeth 23*a*. FIG. 6*a* shows how the teeth 23 are arranged in relation to one another when the door 7 is closed. In this position, the two larger teeth 23*b* of each sector 24 are located between two sectors 24 of the opposite surface 12. FIG. 6*b* shows how the members 10, 11 are arranged when the door 7 is located in a first stop position. In this position, the first member 10 has, for example, been rotated approximately 24° about the axis of rotation 5 at the same time as the second member 11 has remained stationary. Before the door 7 reached this stop position, a small tooth 23*a* of each member 10, 11 passed a larger tooth 23*b*, which resulted in an increase in torque occurring before the first stop position was reached. In order to move the door 7 from the first stop position to a second stop position, as shown in FIG. 6*c*, a given torque must be overcome, as described above. This torque is higher than the torque required to reach the first stop position owing to the fact that two large teeth 23*b*, one on the surface 12 of each member 10, 11, must pass one another. In order for the door 7 to reach a third stop position, as shown in FIG. 6*d*, a torque of essentially the same magnitude as the torque required to move the door 7 from the first stop position to the second stop position must be overcome.

In the event that the door 7 is a vehicle door, the teeth 23 of the first and the second member 10, 11 are preferably orientated in such a manner that the first stop occurs at an opening angle of approximately 24°, the second stop occurs at an opening angle of approximately 50°, and the third stop occurs at an opening angle of approximately 76°.

By virtue of arranging two small teeth 23*a* on the outside in each sector 24, one on each side of two larger teeth 23*b*, one and the same type of stop arrangement 1 can be arranged in vehicle doors on both the right and the left side of the vehicle. The teeth 23 shown in the figures are trapezoidal in shape. It is possible, however, for the teeth to have a different shape, such as teeth 23 with rounded or pointed tops.

According to a second embodiment of the invention, at least one rotatable body 25 can be arranged between those surfaces 12 of the first and the second member 10, 11 which face one another. The body 25 is designed so as to interact: with hollows 26 formed in the surface(s) 12 of the first and/or the second member 10, 11. FIG. 7 shows such an embodiment of the stop arrangement 1. The rotatable body 25 is connected rotatably to the second member 11. Hollows 26 are formed in the first member 10, in which hollows the rotatable body 25 engages when the door 7 reaches a stop position. However, the rotatable body 25 can also consist of at least one ball, roller or pin (not shown) arranged between the surfaces 12.

The stop arrangement 1 according to the exemplary embodiments above can also be mounted on a door 7 and a body part 8 as a separate unit and does not therefore have to be mounted on a hinge 2 as described above.

What is claimed is:

1. A stop arrangement for stopping a door pivotable relative to a body, the stop arrangement comprising:

a first member connectable to the door, a second member connectable to a body part, the first and second members being arranged so that torque generated by the door is variable when the door pivots about its axis of rotation, a first member surface facing the second member and having teeth extending in a ring configuration, a second member surface facing the first member and having teeth extending in a ring configuration, wherein each member surface is divided into at least three sectors, each sector having four teeth, said four teeth further comprising two outer teeth smaller than the remaining teeth, the remaining teeth located between the outer teeth, and a force element able to bring the first and second members together with one another under force whereby the first member is able to interact with the second member, the direction of the force being oriented substantially parallel to a longitudinal direction of the axis of rotation.

2. The stop arrangement as recited in claim 1, the first member being rotatable about the axis of rotation when the door is pivoted about the axis of rotation.

3. The stop arrangement as recited in claim 1, the first member being displaceable in the longitudinal direction of the axis of rotation.

4. The stop arrangement as recited in claim 3, wherein said first member is displaceable in a cylinder having on an inner wall thereof a fixing element that interacts with said first member and prevents said first member from rotating in said cylinder.

5. The stop arrangement as recited in claim 4, the second member being rotatable in the cylinder, wherein at least a portion of the second member is shaped and arranged to define a closed space together with said cylinder.

6. The stop arrangement as recited in claim 1, the first and said second members each having a rotationally symmetrical shape relative to an axis of symmetry that coincides with the axis of rotation about which the door pivots.

7. The stop arrangement as recited in claim 1, further comprising a hinge for connecting the door to the body part, the hinge further comprising a first and a second hinge element, the first hinge element connectable to the door and the second hinge element connectable to the body part, wherein the first member is connectable to the first hinge element and the second member is connectable to the second hinge element.

8. The stop arrangement as recited in claim 1, wherein the force element further comprises a coil spring, the coil spring being able to bias the first member against the second member in the longitudinal direction of the axis of rotation.

9. The stop arrangement as recited in claim 1, wherein each of the surfaces of the first and the second members facing one another are provided with teeth extending in a ring configuration on each surface.

10. The stop arrangement as recited in claim 1, further comprising teeth arranged to limit an angle of rotation of the door.

11. The stop arrangement as recited in claim 1, wherein the door is a passenger door of a vehicle.

12. The stop arrangement as recited in claim 1, wherein the door is a trunk of a vehicle.

13. The stop arrangement as recited in claim 1, wherein the door is a hood of a vehicle.

* * * * *